US010995560B2

(12) United States Patent
Johnson et al.

(10) Patent No.: US 10,995,560 B2
(45) **Date of Patent: *May 4, 2021**

(54) METHOD AND SYSTEM FOR DATA-TRANSFER VIA A DRILL PIPE

(71) Applicant: REI, Inc., Salt Lake City, UT (US)

(72) Inventors: Randall Johnson, Salt Lake City, UT (US); Randy Richardson, South Jordan, UT (US); Daniel J. Brunner, Salt Lake City, UT (US); Alex Schumacher, Salt Lake City, UT (US); Robert Koontz, Herriman, UT (US)

(73) Assignee: REI, INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/193,988

(22) Filed: Nov. 16, 2018

(65) Prior Publication Data

US 2019/0242196 A1 Aug. 8, 2019

Related U.S. Application Data

(63) Continuation of application No. 15/436,334, filed on Feb. 17, 2017, now Pat. No. 10,132,123, which is a continuation-in-part of application No. 15/073,340, filed on Mar. 17, 2016, now Pat. No. 9,580,973, which is a continuation of application No. (Continued)

(51) Int. Cl.

| | |
|---|---|
| ***E21B 17/02*** | (2006.01) |
| ***E21B 19/16*** | (2006.01) |
| ***E21B 17/00*** | (2006.01) |
| ***E21B 47/01*** | (2012.01) |

(Continued)

(52) U.S. Cl.

CPC ..... *E21B 17/028* (2013.01); *E21B 17/003* (2013.01); *E21B 19/16* (2013.01); *E21B 47/01* (2013.01); *E21B 47/12* (2013.01); *E21B 47/13* (2020.05); *Y10T 29/49117* (2015.01)

(58) Field of Classification Search

CPC ..... E21B 17/028; E21B 17/003; E21B 19/16; E21B 47/01; E21B 47/12; E21B 47/122; E21B 17/02; E21B 17/00; Y10T 29/49117

See application file for complete search history.

(56) References Cited

U.S. PATENT DOCUMENTS

| | | | |
|---|---|---|---|
| 3,518,609 | A | 6/1970 | Fontenot, Jr. |
| 4,126,848 | A | 11/1978 | Denison |

(Continued)

FOREIGN PATENT DOCUMENTS

| | | | |
|---|---|---|---|
| SU | 620577 | A1 | 8/1978 |
| WO | WO-95/22679 | A1 | 8/1995 |
| WO | WO-98/23849 | A1 | 6/1998 |

OTHER PUBLICATIONS

Copenheaver, Blaine R., "International Search Report" prepared for PCT/US2013/031982 dated May 31, 2013, 3 pages.

*Primary Examiner* — Yong-Suk (Philip) Ro

(74) *Attorney, Agent, or Firm* — Shackelford, Bowen, McKinley & Norton, LLP

(57) ABSTRACT

A drill-pipe communication assembly includes a first drill pipe segment. A conductor extends at least partially along a length of the first drill pipe segment. An antenna is electrically coupled to the first drill pipe segment. The antenna facilitates wireless transmission of signals from the first drill pipe segment to an adjacent second drill pipe segment.

3 Claims, 20 Drawing Sheets

Related U.S. Application Data

13/800,688, filed on Mar. 13, 2013, now Pat. No. 9,322,223.

(60) Provisional application No. 61/644,896, filed on May 9, 2012.

(51) Int. Cl.
*E21B 47/12* (2012.01)
*E21B 47/13* (2012.01)

(56) References Cited

U.S. PATENT DOCUMENTS

| | | | | |
|---|---|---|---|---|
| 4,483,393 | A | 11/1984 | More et al. | |
| 4,511,842 | A | 4/1985 | Moran et al. | |
| 4,785,247 | A | 11/1988 | Meador et al. | |
| 4,921,438 | A | 5/1990 | Godfrey et al. | |
| 7,190,280 | B2 | 3/2007 | Hall et al. | |
| 7,207,396 | B2 | 4/2007 | Hall et al. | |
| 10,132,123 | B2 * | 11/2018 | Johnson | E21B 47/13 |
| 2004/0056816 | A1 | 3/2004 | Bittar et al. | |
| 2004/0169367 | A1 | 9/2004 | Sutherland et al. | |
| 2004/0242044 | A1 | 12/2004 | Head | |
| 2006/0021799 | A1 | 2/2006 | Hall et al. | |
| 2006/0225926 | A1 | 10/2006 | Madhavan et al. | |
| 2007/0010119 | A1 | 1/2007 | Hall et al. | |
| 2008/0166917 | A1 | 7/2008 | Hall et al. | |
| 2011/0094729 | A1 | 4/2011 | Braden et al. | |
| 2013/0319768 | A1 | 12/2013 | Madhavan et al. | |

* cited by examiner

METHOD AND SYSTEM FOR DATA-TRANSFER VIA A DRILL PIPE

CROSS-REFERENCE TO RELATED APPLICATIONS

This application is a continuation of U.S. patent application Ser. No. 15/436,334, filed on Feb. 17, 2017. U.S. patent application Ser. No. 15/436,334 is a continuation-in-part of U.S. patent application Ser. No. 15/073,340, filed on Mar. 17, 2016. U.S. patent application Ser. No. 15/073,340 is a continuation of U.S. patent application Ser. No. 13/800,688, filed Mar. 13, 2013. U.S. patent application Ser. No. 13/800,688 claims priority to U.S. Provisional Patent Application No. 61/644,896, filed May 9, 2012. U.S. patent application Ser. No. 15/436,334, U.S. patent application Ser. No. 15/073,340, U.S. patent application Ser. No. 13/800,688, and U.S. Provisional Patent Application No. 61/644,896 are each incorporated herein by reference.

BACKGROUND

Field of the Invention

The present application relates generally to drilling and mining operations and more particularly, but not by way of limitation, to a drill pipe that facilitates transmission of data.

History of the Related Art

The practice of drilling non-vertical wells through directional drilling (sometimes referred to as "slant drilling") has become very common in energy and mining industries. Directional drilling exposes a larger section of subterranean reservoirs than vertical drilling, and allows multiple subterranean locations to be reached from a single drilling location thereby reducing costs associated with operating multiple drilling rigs. In addition, directional drilling often allows access to subterranean formations where vertical access is difficult or impossible such as, for example, formations located under a populated area or formations located under a body of water or other natural impediment.

Despite the many advantages of directional drilling, the high cost associated with completing a well is often cited as the largest shortcoming of directional drilling. This is due to the fact that directional drilling is often much slower than vertical drilling due to requisite data-acquisition steps. Data acquisition requires an electrical connection to be present between a down-hole tool and surface equipment. Embedding an electrical conductor into a drill rod expedites data acquisition associated with directional drilling and reduces overall costs associated with directional drilling.

SUMMARY

The present application relates generally to drilling and mining operations and more particularly, but not by way of limitation, to a drill pipe that facilitates transmission of data. In one aspect, the present invention relates to drill-pipe communication assembly includes a first drill pipe segment. A conductor extends at least partially along a length of the first drill pipe segment. An antenna is electrically coupled to the first drill pipe segment. The antenna facilitates wireless transmission of signals from the first drill pipe segment to an adjacent second drill pipe segment.

In another aspect, the present invention relates to a drill-pipe communication assembly. The drill-pipe communication assembly includes a first drill pipe and an insulated tube disposed within, and generally concentric with, the first drill pipe. A male insert is disposed within a first end of the first drill pipe and a female insert is disposed within a second end of the first drill pipe. A conductor is electrically coupled to the male insert and the female insert. The conductor extends along a length of the first drill pipe. The conductor facilitates transmission of electrical signals from the first end of the first drill pipe to the second end of the first drill pipe.

In another aspect, the present invention relates to a method of installing a drill-pipe communication assembly. The method includes inserting a female insert into a first end of a drill pipe and inserting an insulated tube into a second end of the drill pipe. The method further includes inserting a male insert into the second end of the drill pipe. A conductor is electrically coupled to the female insert and the male insert. Electrical signals are transmitted, via the conductor, from the first end of the drill pipe to the second end of the drill pipe.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
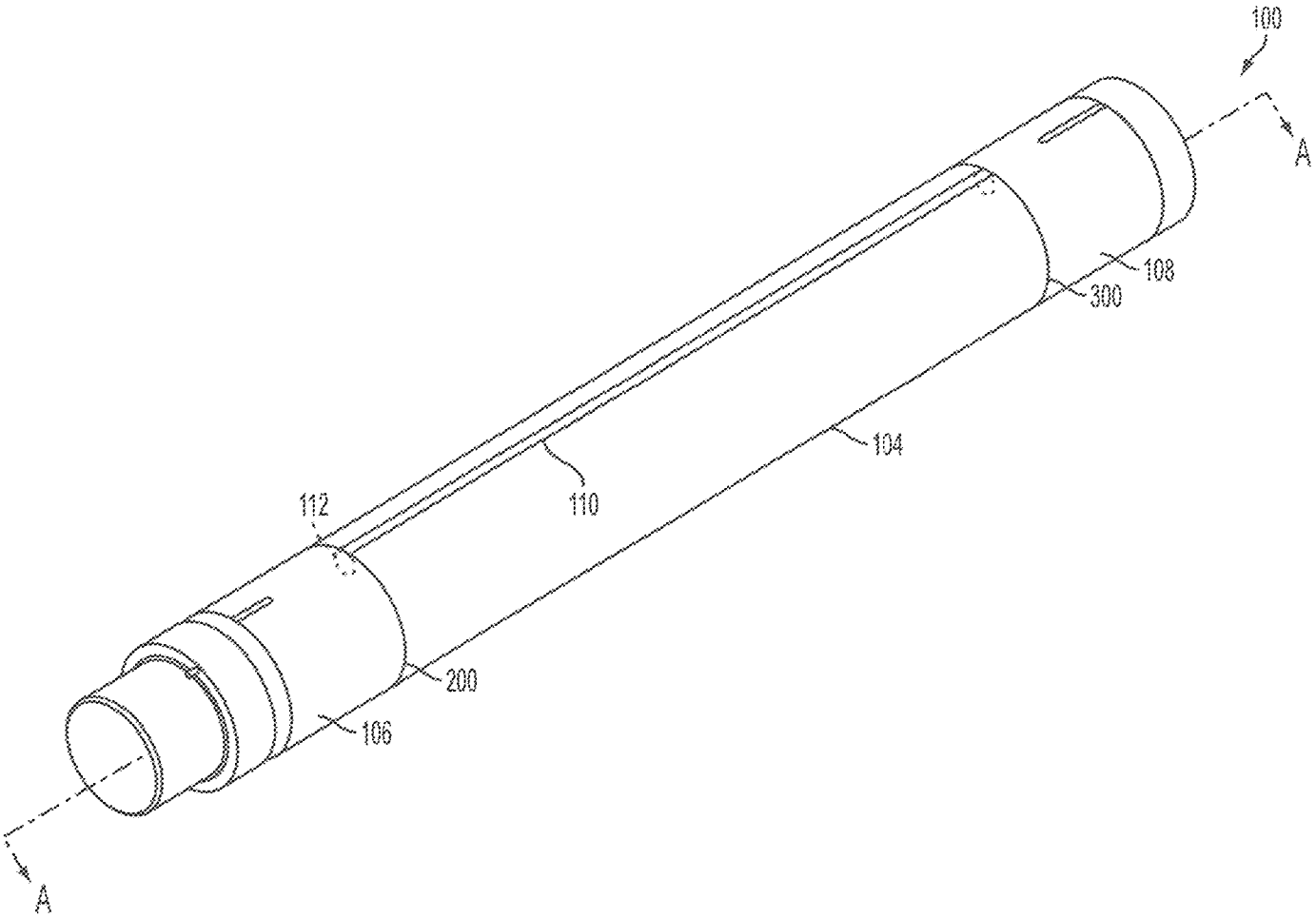
FIG. 1 is a perspective view of a drill-pipe communication assembly according to an exemplary embodiment.

FIG. 1 is a perspective view of a drill-pipe communication assembly 100. In a typical embodiment, the drill-pipe communication assembly 100 is disposed within a drill pipe 402 (shown in FIG. 4A). An insulated tube 104 is disposed within the drill pipe 402. In a typical embodiment, the insulated tube 104 is constructed of an electrically-non-conductive material such as, for example, ABS plastic, carbon fiber, ceramic, or other appropriate material. A male insert 106 abuts a first end 200 and a female insert 108 abuts a second 300 end of the insulated tube. In a typical embodiment the drill pipe is constructed of, for example, steel or other appropriate material. A groove 110 is formed in an outer surface of the insulated tube 104 and is oriented generally parallel to a length of the insulated tube 104. A conductor 112 is disposed in the groove 110 and is electrically coupled to the male insert 106 and the female insert 108. In a typical embodiment, the conductor 112 is, for example, a co-axial cable. However, in other embodiments, drill-pipe communication assemblies utilizing principles of the invention may include conductors such as, for example, a microstrip, flat or ribbon wire, an Ethernet cable, a fiber-optic cable, a transverse electromagnetic transmission line such as, for example, stripline, or other appropriate conductor as dictated by design requirements.

Figure 2A:
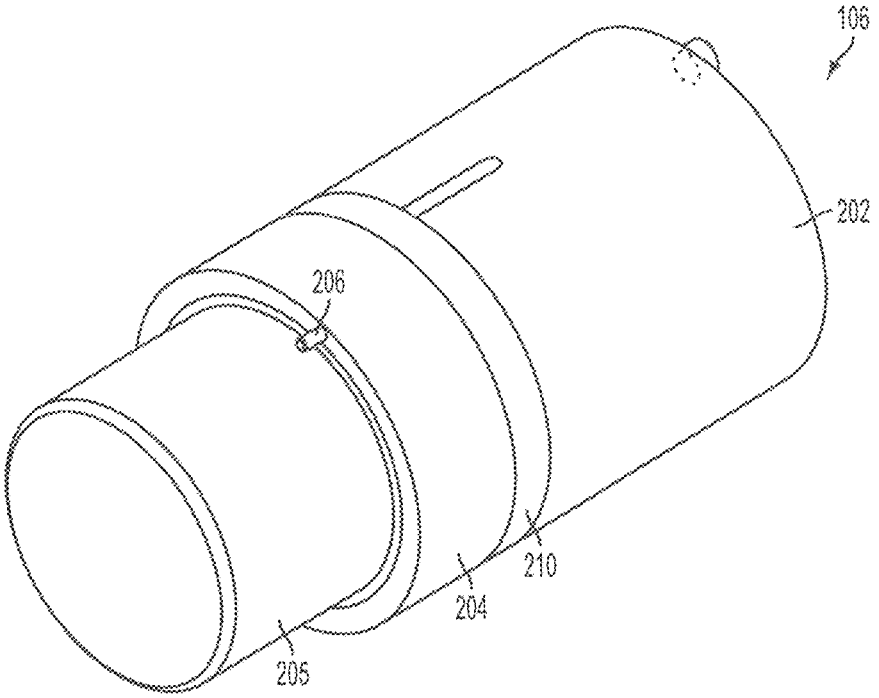
FIG. 2A is a perspective view of a male insert according to an exemplary embodiment.
Figure 2B:
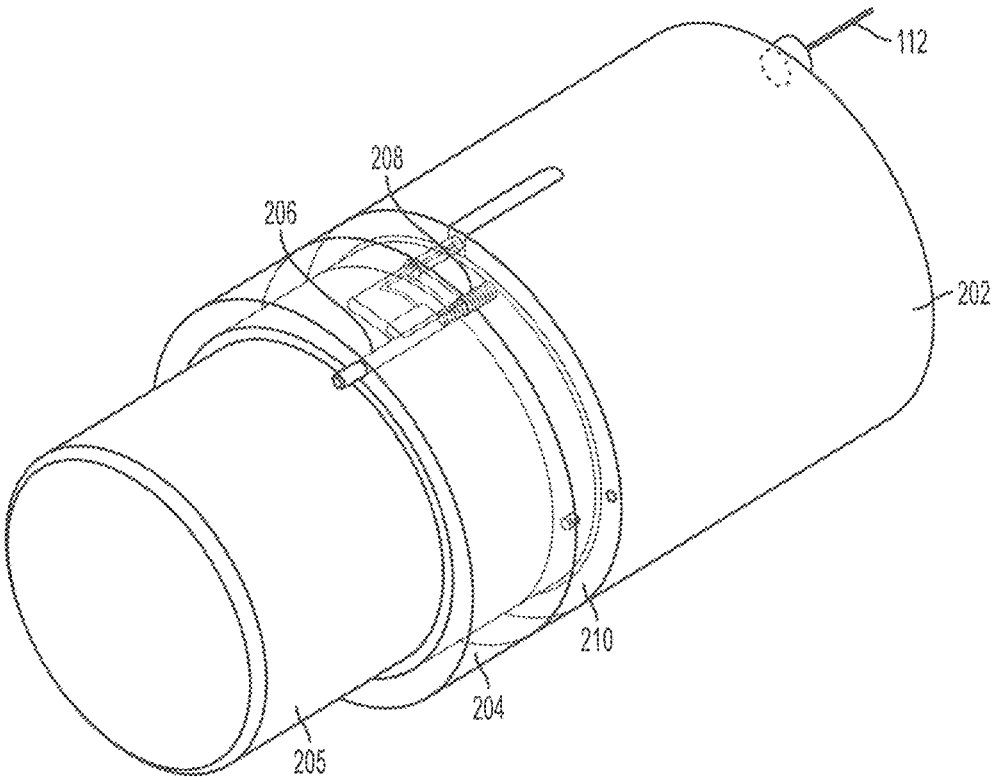
FIG. 2B is a perspective view of the male insert of FIG. 2A with an insulating ring shown as transparent according to an exemplary embodiment.

FIG. 2A is a perspective view of the male insert 106. FIG. 2B is a perspective view of the male insert 106 with a first insulating ring and a second insulating ring shown as transparent. Referring to FIGS. 2A and 2B, in a typical embodiment, the male insert 106 is operable to couple with a female insert 108 (shown in FIG. 1) associated with an adjacent drill pipe (not shown). The male insert includes a body 202, a first insulating ring 204 surrounding a portion of the body 202, a second insulating ring 210 surrounding a portion of the body 202 and positioned adjacent to the first insulating ring 204, and a pin 206 disposed through the first insulating ring 204. In a typical embodiment the body 202 is constructed from a material such as, for example, stainless steel; however, in other embodiments, other materials may be utilized. A rabbet 205 is formed in the body 202 and the first insulating ring 204 and the second insulating ring 210 disposed about a circumference of the rabbet 205. In a typical embodiment, the pin 206 is electrically coupled to the conductor 112 and is constructed of an electrically-conductive material such as, for example copper, aluminum, or other appropriate material. As shown in FIG. 2B, a spring 208 is disposed within the insulating ring 204 between the pin 206 and the second insulating ring 210. In a typical embodiment, the spring 208 biases the pin 206 in a forward direction to facilitate electrical contact between the male insert 106 and a female insert 108 (shown in FIG. 1) associated with an adjacent drill pipe (not shown). In a typical embodiment, the conductor 112, the pin 206, and the female conductor ring 306 (shown in FIGS. 3A-3B) form a continuous wire line capable of transmitting data in the form of electrical signals between the male insert 106 and the female insert 108.

Figure 3A:
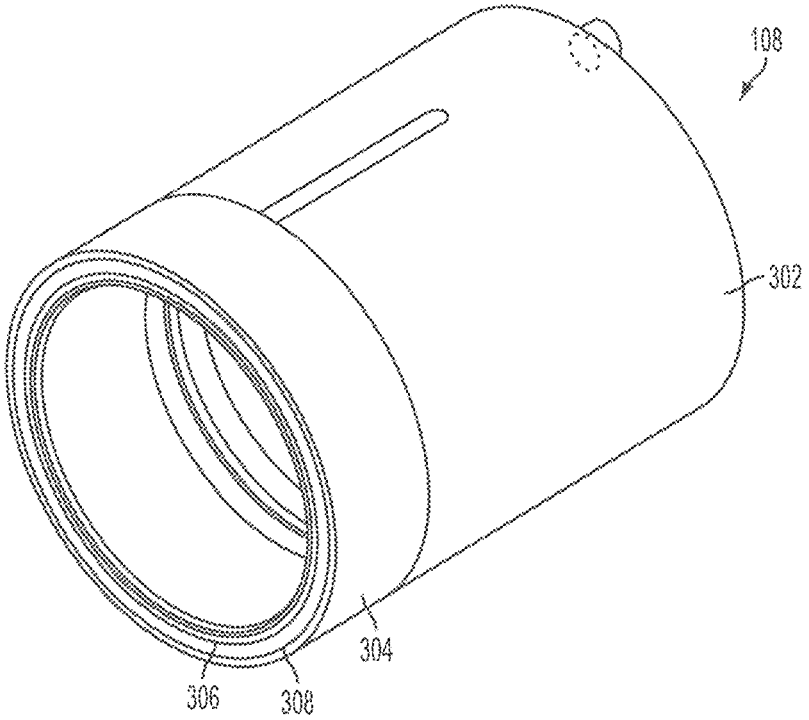
FIG. 3A is a perspective view of a female insert according to an exemplary embodiment.
Figure 3B:
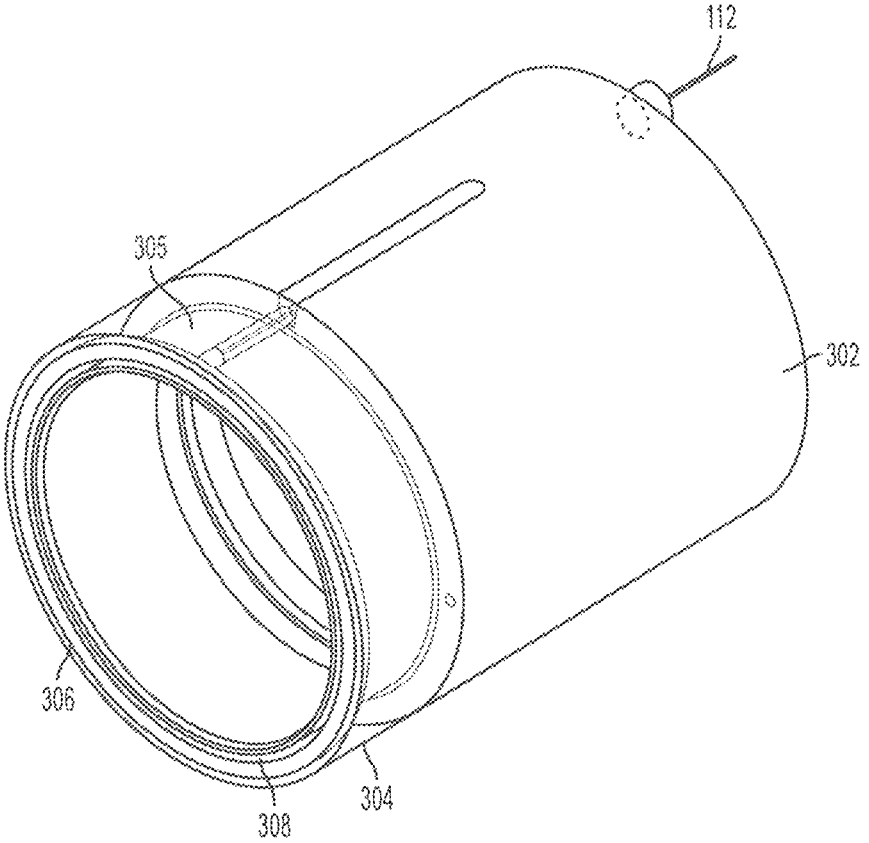
FIG. 3B is a perspective view of the female insert of FIG. 3B with an insulating ring shown as transparent according to an exemplary embodiment.

FIG. 3A is a perspective view of the female insert 108. FIG. 3B is a perspective view of the female insert 108 with an insulating ring shown as transparent. In a typical embodiment, the female insert 108 is, for example, operable to couple with a male insert 106 (shown in FIG. 1) of an adjacent drill pipe (not shown). The female insert 108 includes a body 302, an insulating ring 304 disposed about the body 302, and a female conductor ring 306. In a typical embodiment, the body 302 is constructed from a material such as, for example, stainless steel; however, in other embodiments, other materials may be utilized. A rabbet 305 is formed in the body 302 and the insulating ring 304 is disposed about a circumference of the rabbet 305. In a typical embodiment, the female conductor ring 306 is constructed of an electrically-conductive material such as, for example copper, aluminum, or other appropriate material. The female conductor ring 306 is disposed within a groove 308 formed in an outer face of the insulating ring 304. In a typical embodiment, the groove 308 forms a track that receives a pin (not shown) associated with a male insert 106 (shown in FIG. 1) of an adjacent drill pipe (not shown). The groove 308 facilitates contact between the pin 206 of an adjacent drill pipe and the female conductor ring 306. As shown in FIG. 3B, the female conductor ring 306 is electrically coupled to the conductor 112. Thus, combination of the pin 206, the female conductor ring 306, and the conductor 112 allows transmission of electrical signals from, for example, the male insert 106 to the female insert 108.

Figure 4A:
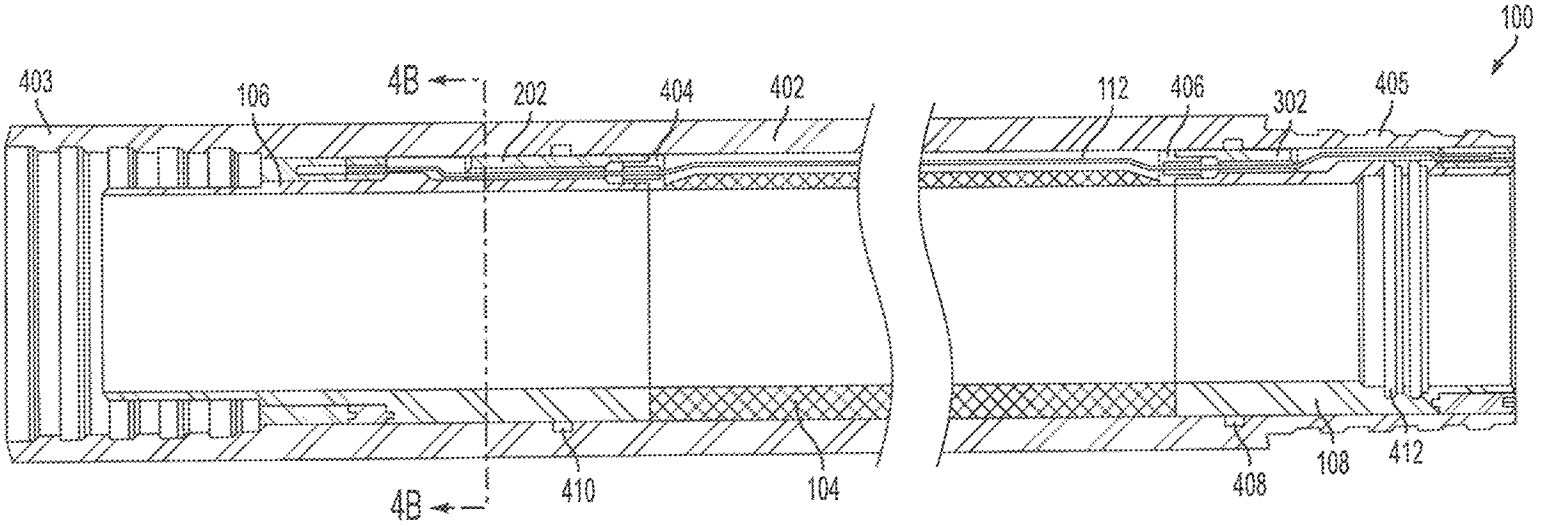
FIG. 4A is a cross-sectional view along the line A-A of the drill-pipe communication assembly of FIG. 1 according to an exemplary embodiment.
Figure 4B:
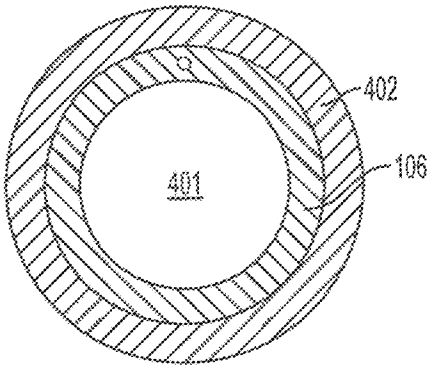
FIG. 4B is a cross-sectional view along the line B-B of the drill-pipe communication assembly of FIG. 4A according to an exemplary embodiment.

FIG. 4A is a cross-sectional view along the line A-A of the drill-pipe communication assembly 100. FIG. 4B is a cross-sectional view along the line B-B of the drill-pipe communication assembly 100. Referring to FIGS. 4A-4B, the insulated tube 104 is received within, and is generally concentric with, the drill pipe 402. A central space 401 is formed within an interior of the insulated tube 104. The central space 401 allows for transmission of fluids, tools, and other items through the drill-pipe communication assembly 100. The insulated tube 104 insulates the conductor 112 from materials that may be present in the central space 401. Thus, the drill-pipe communication assembly 100 allows data related to, for example, tool depth and telemetry, to be transmitted, via the conductor 112, without blocking or otherwise reducing a size of the central space 401.

Still referring to FIGS. 4A and 4B, the male insert 106 is inserted into a female end 403 of the drill pipe 402 and the female insert 108 is inserted into a male end 405 of the drill pipe 402. The male insert 106 abuts the first end 200 (shown in FIG. 1) of the insulated tube 104 and the female insert 108 abuts the second end 300 (shown in FIG. 1) of the insulated tube 104. The conductor 112 is electrically coupled to both the male insert 106 and the female insert 108. The conductor 112 traverses a length of the insulated tube 104 between the male insert 106 and the female insert 108. Thus, the combination of the conductor 112, the male insert 106, and the female insert 108 allows transmission of electrical signals along a length of the drill pipe 402. A first compression grommet 404 is disposed in the body 202 of the male insert 106. The first compression grommet 404 is disposed about the conductor 112. In a typical embodiment, the first compression grommet 404 prevents infiltration of, for example, water or drilling fluids, into the male insert 106. A second compression grommet 406 is disposed in the body 302 of the female insert 108. The second compression grommet 406 is disposed about the conductor 112. In a typical embodiment, the second compression grommet 406 prevents infiltration of, for example, water or drilling fluids, into the female insert 108.

Still referring to FIGS. 4A-4B, a first seal 408 is disposed about an interior circumference of the drill pipe 402 proximate to the female insert 108. In a typical embodiment, the first seal 408 includes a single O-ring; however, in alternate embodiments, the first seal 408 may include a double O-ring, a gasket, or other sealing device as dictated by design requirements. During operation, the first seal 408 prevents infiltration of, for example, fluid and other contaminants into a region of the drill pipe 402 containing the female insert 108. A second seal 410 is disposed about an interior circumference of the drill pipe 402 proximate to the male insert 106. In a typical embodiment, the second seal 410 includes a single O-ring; however, in alternate embodiments, the second seal 410 may include a double O-ring, a gasket, or other sealing device as dictated by design requirements. During operation, the second seal 410 prevents infiltration of, for example, fluid and other contaminants into a region of the drill pipe 402 containing the male insert 106. A third seal 412 is disposed about an interior circumference of the female insert 108. In a typical embodiment, the third seal 412 includes a double O-ring; however, in other embodiments, the third seal 412 may include a single O-ring or other sealing device as dictated by design requirements. During operation, the third seal 412 seats on a circumferential face of the male insert 106 and prevents infiltration of, for example, fluid and other contaminants into a region of the drill pipe 402 containing a junction between the male insert 106 and the female insert 108.

Figure 5A:
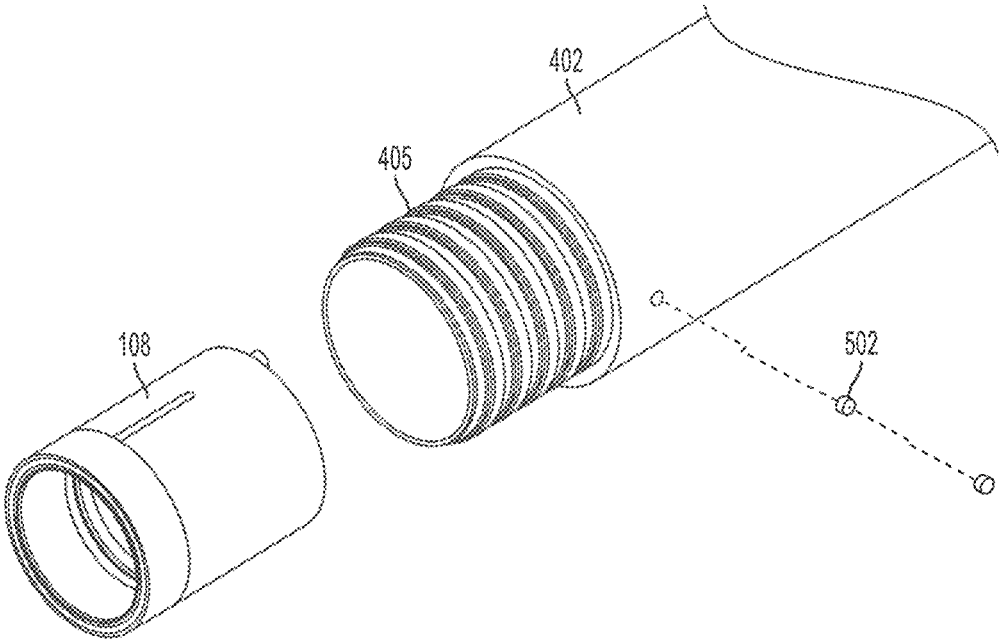
FIG. 5A is an exploded perspective view of a female insert of FIG. 3A illustrating assembly with a drill rod according to an exemplary embodiment.
Figure 5B:
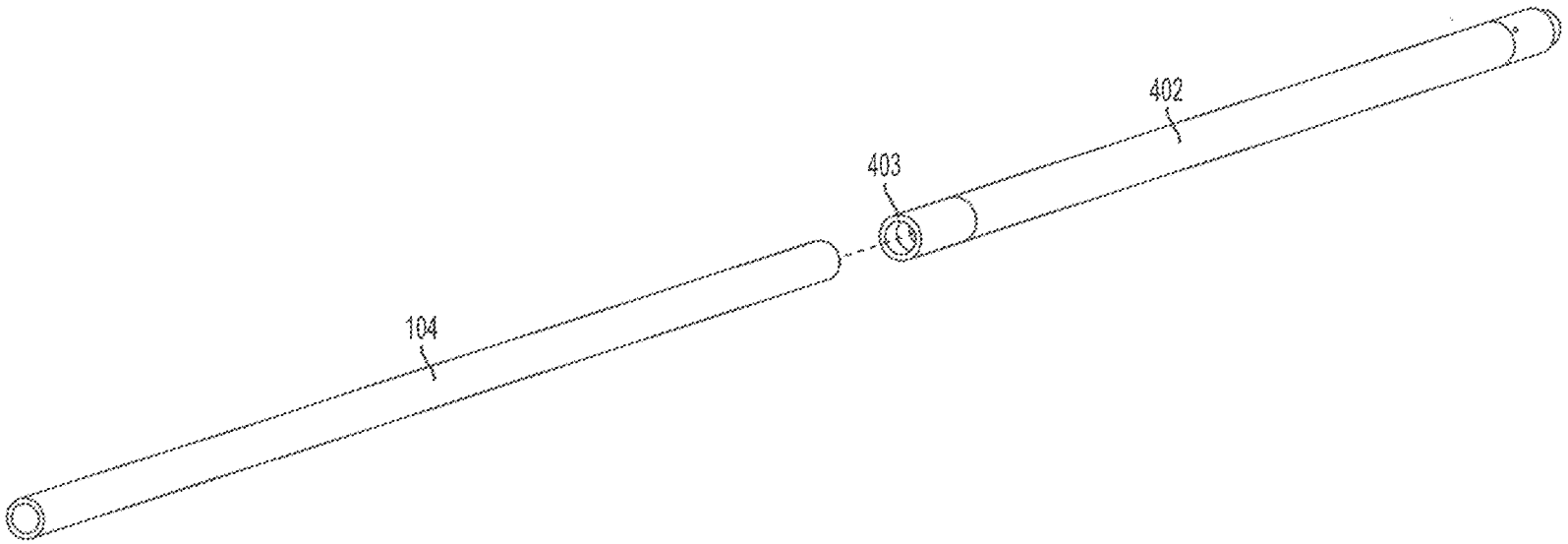
FIG. 5B is an exploded perspective view of an insulated tube illustrating assembly with a drill rod according to an exemplary embodiment.
Figure 5C:
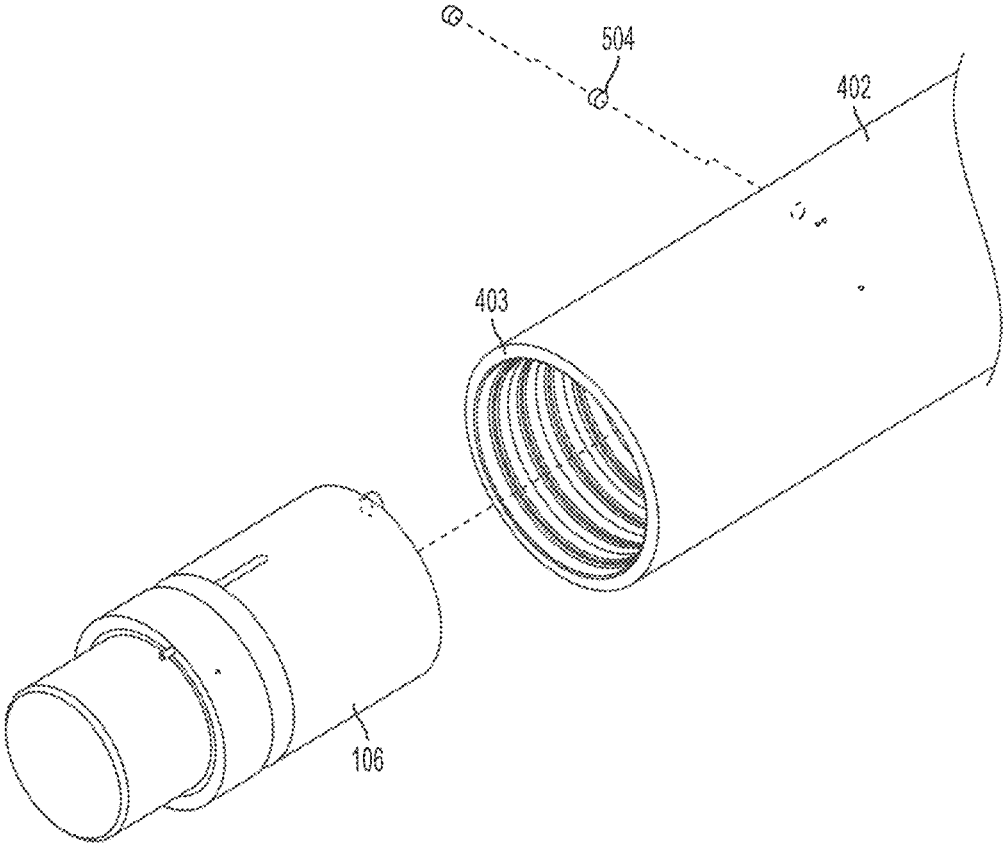
FIG. 5C is an exploded perspective view of the male insert of FIG. 2A illustrating assembly with a drill rod according to an exemplary embodiment.

FIG. 5A is an exploded perspective view of the female insert 108 illustrating assembly with the drill pipe 402. FIG. 5B is an exploded perspective view of the insulated tube 104 illustrating assembly with the drill pipe 402. FIG. 5C is an exploded perspective view of the male insert 106 illustrating assembly with the drill pipe 402. As will be illustrated in FIGS. 5A-5C, the drill-pipe communication assembly 100 may be utilized in combination with a pre-existing drill pipe. Thus, the drill-pipe communication assembly 100 allows previously unwired drill pipe to be retro-fitted to allow data transfer.

As shown in FIG. 5A, the female insert 108 is inserted into a male end 405 of the drill pipe 402. The female insert 108 is held in place within the drill pipe 402 via first fasteners 502 or a press fit. In a typical embodiment, the first fasteners 502 are, for example, set screws; however, in other embodiments, the first fasteners 502 may be, for example, pins, rivets, or any other appropriate fastener as dictated by design requirements. As shown in FIG. 5B, the insulated tube 104 is inserted into a female end 403 of the drill pipe 402. As discussed hereinabove, the groove 110, having the conductor 112 disposed therein, is formed in the insulated tube 104. The conductor 112 is electrically coupled to the female insert 108. In a typical embodiment, insertion of the insulated tube 104 occurs after insertion of the female insert 108. As shown in FIG. 5C, the male insert 106 is inserted into a female end 403 of the drill pipe 402. The male insert 106 is held in place within the drill pipe 402 via second fasteners 504 or a press fit. In a typical embodiment, the second fasteners 504 are, for example, set screws; however, in other embodiments, the second fasteners 504 may be, for example, pins, rivets, or any other appropriate fastener as dictated by design requirements.

Figure 6:
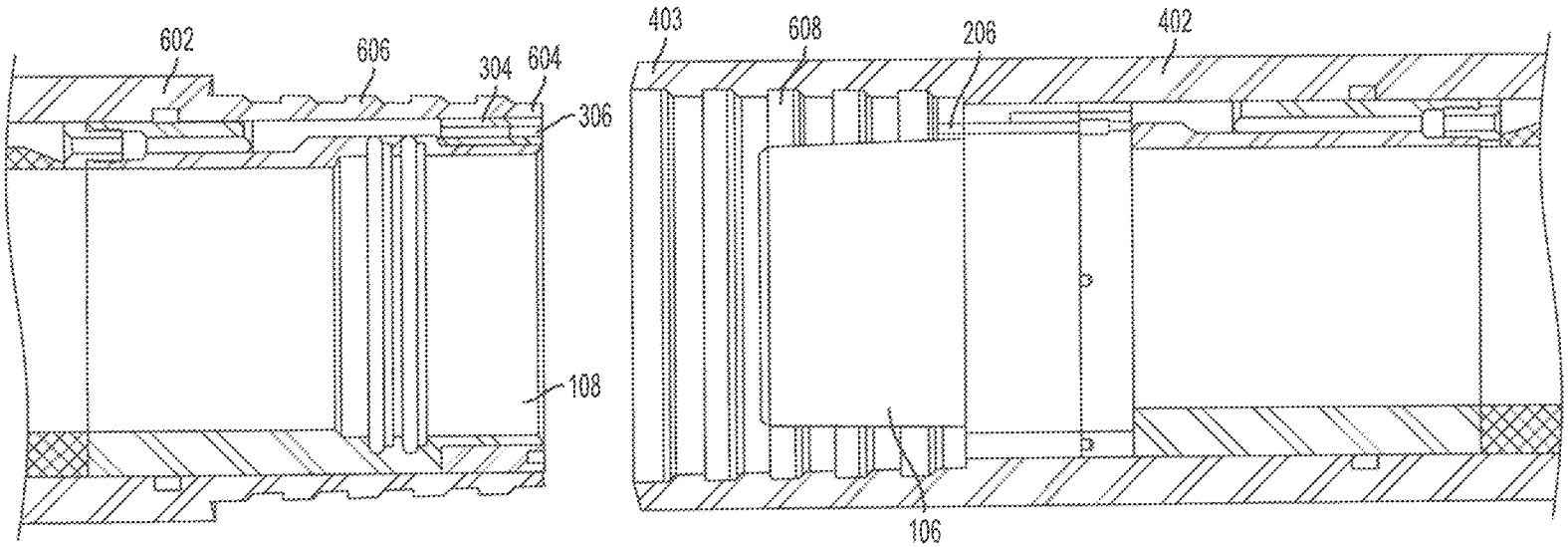
FIG. 6 is a cross-section view of a junction between two adjacent drill pipes according to an exemplary embodiment.

FIG. 6 is a cross-sectional view of a junction between, for example, the female end 403 of the drill pipe 402 and a male end 604 of an adjacent drill pipe 602. As shown in FIG. 6, the male end 604 includes, for example, male threads 606 and the female end 403 includes, for example, female threads 608. The male insert 106 is disposed in the female end 403 and the female insert 108 is disposed in the male end 604. Upon engagement of the male threads 606 with the female threads 608, the pin 206 engages the female conductor ring 306 disposed in the groove 308 thereby facilitating an electrical connection between the drill pipe 402 and the adjacent drill pipe 602. Such an electrical connection allows the transmission of, for example, measurements, telemetry, and other data obtained by a downhole tool to, for example surface instrumentation.

The advantages of the drill-pipe communication assembly 100 will be apparent to those skilled in the art. First, the drill-pipe communication assembly 100 provides a continuous wire line for transmission of electrical signals from, for example, a down-hole tool to surface drilling equipment via the conductor 112, the pin 206, and the female conductor ring 306. Second, the drill-pipe communication assembly 100 allows for the passage of fluids, tools, and other items through the central space 401. Third, the insulated tube 104, including the conductor 112, the pin 206, and the female conductor ring 306, may be assembled during a manufacturing process for the drill pipe 402 or after manufacturing of a drill pipe. In this sense, the drill-pipe communication assembly 100 allows the existing drill pipe 402 to be fitted or retro-fitted.

Figure 7:
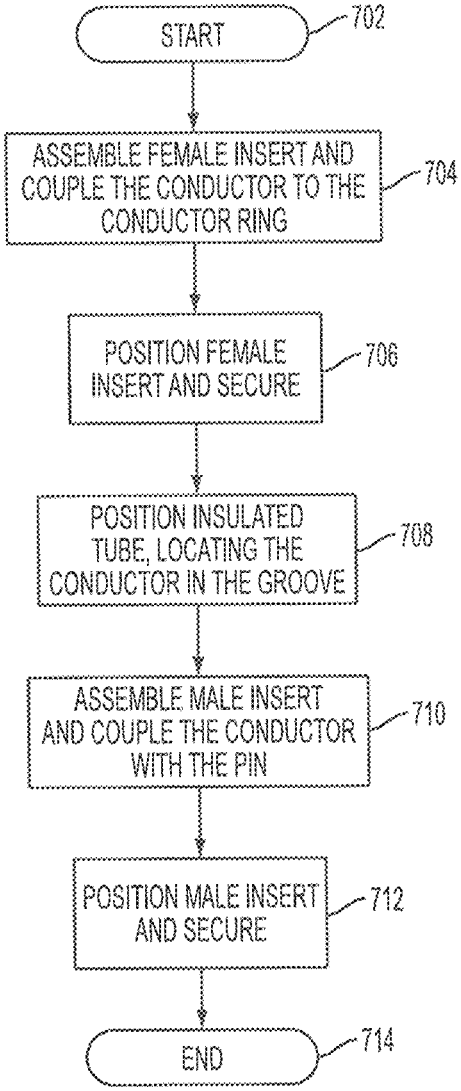
FIG. 7 is a flow diagram of a process for installing the drill-pipe communication assembly of FIG. 1 according to an exemplary embodiment.

FIG. 7 is a flow diagram of a process 700 for installing the drill-pipe communication assembly 100. The process 700 begins at step 702. At step 704, the female conductor ring 108 is assembled and coupled to the conductor 112. At step 706, the female insert 108 is positioned and secured in the male end 405 of the drill pipe 402. At step 708, the insulated tube 104 is inserted into the female end 403 of the drill pipe 402. At step 710, the male insert 106 is assembled and coupled to the conductor 112. At step 712, the male insert is positioned and secured in the female end 403 of the drill pipe 402. The process ends at step 714.

Pipes are used to transport fluids, gasses, slurries, or solid particulates. The following embodiments utilize the walls of pipes that have physical characteristics that allow for radio frequency energy to be transmitted and to collect and pass intelligence through and along the walls of pipe. Pipes that do not have characteristics that will allow RF signals to pass along their length may be equipped either on the inner diameter ("ID") or outer diameter ("OD") with a pipe of a material that does. This may be done via, for example, simple insertion (pipe in pipe), bonding to the pipe, or molding to the internal diameter or external diameter of the pipe. In addition to transmitting data between the pipe's origin and destination, repeaters are capable of collecting pipe status data from sensors along the pipe including content data (gas or liquid velocity, pressures, temperature, cavitation) and data regarding the status of the pipe itself (temperature, vibration, acoustic changes to detect leaks, breakage, failure), the environment surrounding the pipe (surface temperature, UV exposure, etc.), and if the pipe is a drill string, the relative location of the bit compared to the start of drilling (accelerometer, gyro, magnetometer), and information about the surrounding formation (gamma ray, temperature, acoustic, other geophysical sensors). A redundant recessed reflector antenna may be used to pass the signal each direction along the length of the pipe.

Figure 8A:
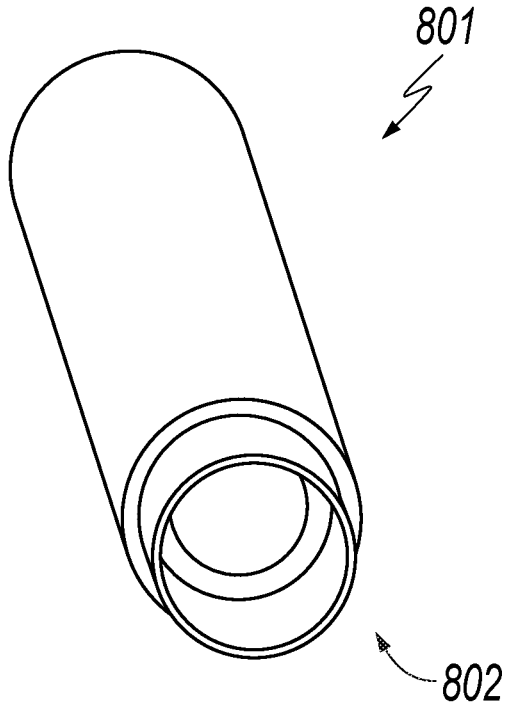
FIG. 8A is a perspective view of a pipe having an RF signal path according to an exemplary embodiment.
Figure 8B:
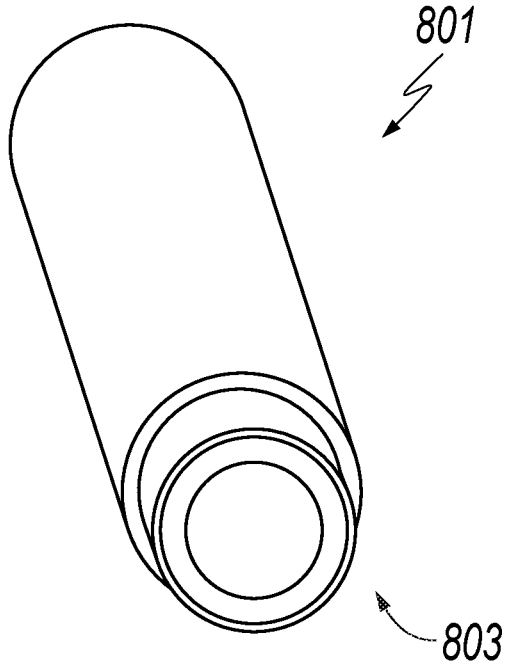
FIG. 8B is a perspective view of a pipe having a repeater module according to an exemplary embodiment.

FIG. 8A is a perspective view of a pipe having an RF signal path. FIG. 8B is a perspective view of a pipe having a repeater module. Referring to FIGS. 8A and 8B collectively, a first pipe 801 is made up of a material that will not pass radio frequency (RF) signals. A second pipe 802 is inserted inside the ID of the first pipe 801 (slip-in pipe in pipe, pipe 802 is bonded to the internal diameter of the first pipe 801, or the second pipe 802 is molded to the internal diameter of the first pipe 801, in both cases such that the internal pipe butts together at the first pipe 801 joints). The second pipe 802 acts as a path for the RF signal to pass. As the RF signal attenuates, repeater modules 803 are inserted in line with the second pipe 802, to boost them back to original levels.

Figure 9A:
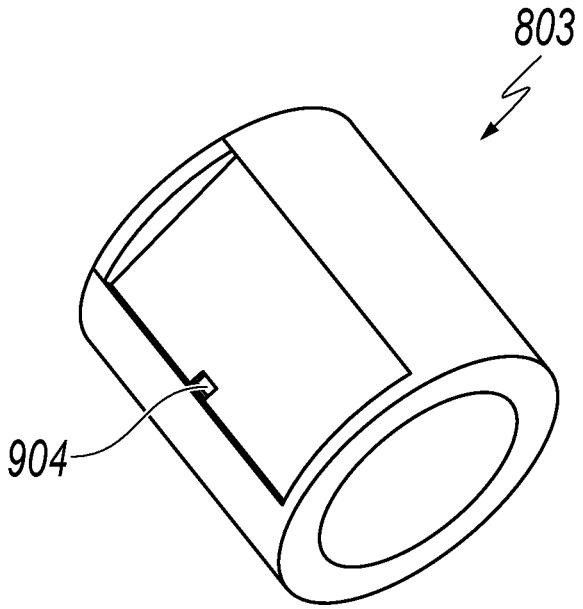
FIG. 9A is a perspective view of a rear aspect of a repeater module according to an exemplary embodiment.
Figure 9B:
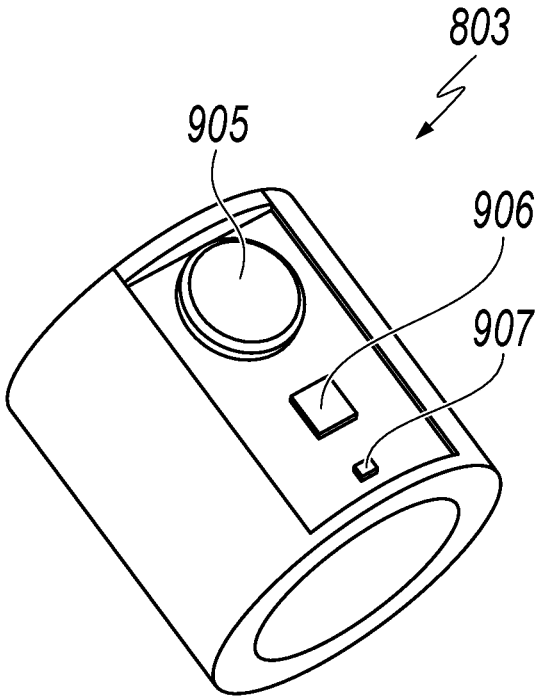
FIG. 9B is a perspective view of a front aspect of a repeater module according to an exemplary embodiment.

FIG. 9A is a perspective view of a rear aspect of a repeater module. FIG. 9B is a perspective view of a front aspect of a repeater module. Referring to FIGS. 9A and 9B collectively, each repeater module 803 has an antenna port 904 located on the back side of a printed circuit board ("PCB") 905. The antenna 904 is used to transmit and receive RF signals in both directions along the length of the pipe. The antenna 904 is driven by and feeds to a master control unit ("MCU") 906. The MCU 906 is programmable and is capable of controlling both the transmission and reception functions of the antenna. As indicated previously, sensors located inside of the second pipe 802 or outside of the first pipe 801 may be monitored by the repeater module 803. For this drill pipe example, an accelerometer/gyroscope 907 is used to monitor the movements of the pipe. The battery cell 905 is replaceable.

Redundant repeater antennas 904 may be installed around the periphery of the repeater module 903 to process signals that may not physically be able to radiate to the next repeater due to line of sight signals issues (microwave frequency signals generally do not bend around objects without significant losses) due to conductive liquids flowing inside the pipe.

For extended power durations, multiple batteries may be used by extending the repeater length. Larger batteries may be used in applications where thicker pipe walls or larger pipe diameters are employed.

Figure 10:
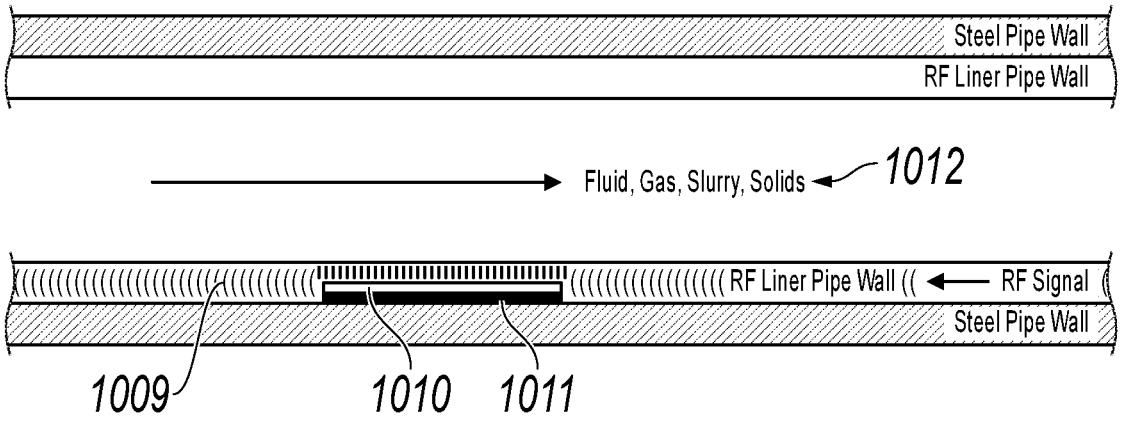
FIG. 10 is a cross-sectional view of a pipe that does not transmit an RF signal according to an exemplary embodiment.

FIG. 10 illustrates a cross-section of a steel pipe 1008 that does not transmit RF signal fitted with an internal pipe 1009 that does transmit RF signal. Fluids, gas, slurry, or solids 1012 flow along the internal diameter of the internal pipe 1009. The repeater antenna 1010 can be mounted in a recess in the outer diameter of the internal pipe 1009 which also accommodates the PCB 1011. Repeater antennas 1010 receive and re-transmit the RF signal along the pipe wall as shown in FIG. 3.

Figure 11:
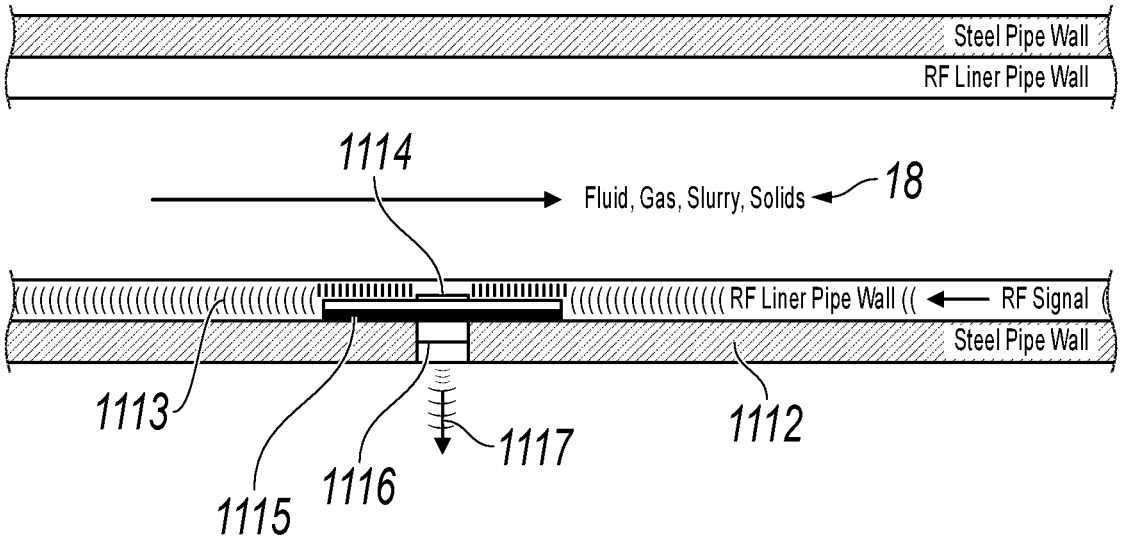
FIG. 11 is a cross sectional view of a pipe that is capable of transmitting an RF signal according to an exemplary embodiment.

FIG. 11 illustrates the transmission of RF signal from the internal pipe 1113 that is capable of transmitting RF signal, to outside 1117 of the outer diameter of a pipe 1112 that is not capable of transmitting RF signal, using recessed reflector antennas 1116 mounted in a sealed port in the steel pipe 1112. A receiving antenna 1114 is mounted above the PCB 1115 on an interior surface of the steel pipe 1112. A cover separates the PCB 1115 from the steel pipe 1112. The bond between the steel pipe 1112 and the internal pipe that is capable of transmitting RF signal 1113 provides the ability to transmit RF outside of the pipe through sealed ports.

Figure 12A:
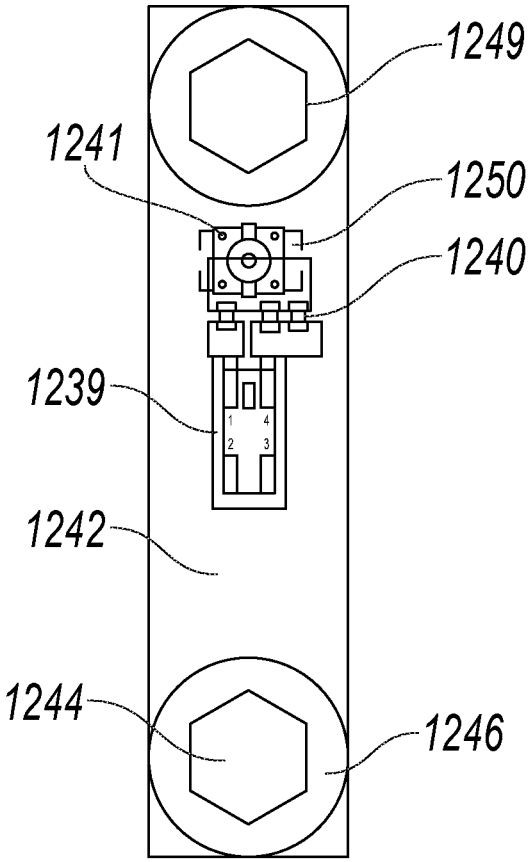
FIG. 12A is an end view of a remote recessed reflector antenna according to an exemplary embodiment.
Figure 12B:
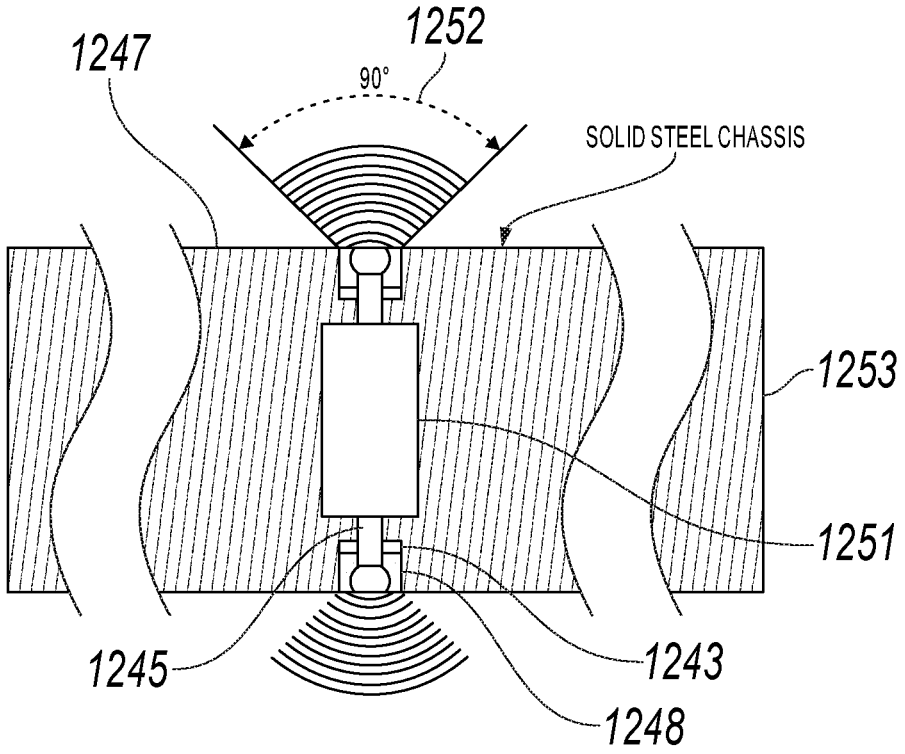
FIG. 12B is a cross-sectional view of a remote recessed reflector antenna according to an exemplary embodiment.

FIG. 12A is an end view of a remote recessed reflector antenna. FIG. 12B is a cross-sectional view of a remote recessed reflector antenna. According to FIGS. 12A and 12B, transmission of data outside of a pipe that does not transmit RF is accomplished by use of recessed antennas mounted through ports in the pipe. The recessed antenna may be encapsulated or otherwise covered with materials that will best withstand the application. PTFE (Polytetrafluoroethylene, also known as Teflon) is an example of one material that may be well suited to this application for the following reasons: it has low surface friction; it is rigid; and it does not significantly attenuate radio frequency transmissions. Small gaps around covers made of materials such as PTFE, may be sealed from moisture using epoxy or other suitable sealants. The size of the aperture used for wireless transmission must be minimized to best protect the antenna and associated circuits. One or more antennas may be implemented for this application, based on the need to radiate and receive signals in multiple directions.

Features of this recessed reflector antenna embodiment are shown in FIGS. 12A and 12B. The antenna 1239, series and shunt tuning components 1240 and cable connector 1242 are mounted on a small circuit board 1242 that is positioned in the antenna cavity 1243 with two mounting holes 1244 aligned with threaded screw holes 1245 in the bottom of the antenna cavity 1243. The bottom sides of the two screw holes 1244 in the circuit board 1242 have exposed annular rings 1246 that are conductively bonded to the steel surface of the bottom of the cavity 1243 using an electrically conductive compound. This conductive joint between the grounded PCB 1230 annular rings 1246 extends the circuit board 1242 ground plane into the steel chassis 1253. This overall ground plane acts as the reflector for the antenna. The antenna reflector is a critical topology for this type of antenna 1239 to operate. In a typical embodiment, the method of mounting these types of antennas is, for example, on the edges of flat corner surface reflectors. Mounting the antenna 1239 on flat surface corner reflectors is not possible because the surfaces 1247 are contoured such that they have no corners. Recessing the antenna 1239 into the surface prevents it from being scraped off by the outside environment.

The antenna 1239 and circuit board 1242 is further protected with a cover 1248 formed out of a material (such as polytetraflouroethylene PTFE) that fills the cavity 1243 in front of the antenna 1239 and which is attached by two screws 1249. Connectors 1241 are attached to RF cables 1250. RF cables 1250 carry signals to and from the transceiver and processing circuit board 1251. Dimensions of the cavity are critical because they allow the radiation pattern 1252 to be ninety degrees (or greater, by altering these dimensions, when practical). The set of cavity 1243 dimensions in this example may obviously be altered, as required, for similar embodiments. Recessing the antenna 1239 changes the radiation characteristics from an omnidirectional configuration that is characteristic of radiation reflected off a flat reflector to radiation reflected off of a horn antenna. This will make the antenna 1239 beam operate in a directional pattern.

The antennas may also be used to transition from the inside of the pipe to the outside of the pipe to allow signals to be passed to/from sensors or for monitoring purposes.

Figure 13:
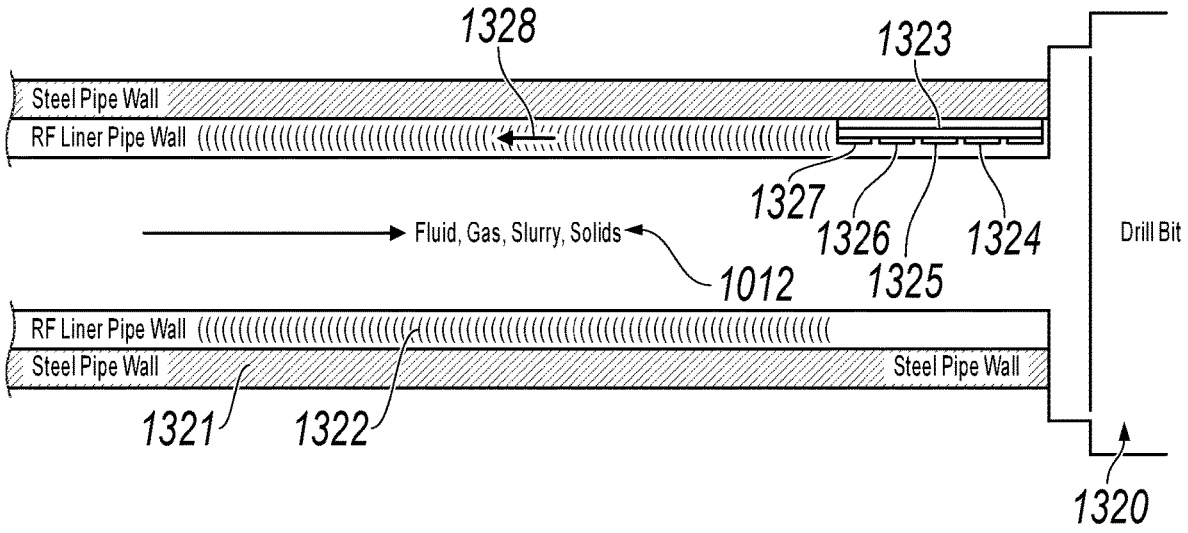
FIG. 13 is a cross-sectional view of a pipe illustrating RF signal transmission according to an exemplary embodiment.

FIG. 13 illustrates the transmission of RF signal 1328 along an inner pipe wall 1322 that is capable of transmitting RF signal and that is mounted to the internal diameter of a drill pipe 1321, with drilling fluids 1329 flowing through the internal diameter of the inner pipe towards the drill bit 1320. Near the bit 1320 and imbedded in the outer diameter of the internal pipe capable of transmitting RF signal 1322 is a PCB mounted annular sensor package 1323 comprised of a multitude of sensors to derive spatial proximity of the drill bit relative to the start of drilling including accelerometers, magnetometers, gyroscopic 1326, geophysical parameters, including gamma ray, acoustic, neutron, etc. 1325, and, temperature or pressure 1324, or any other parameter of significance to drilling, and an antennae 1327 to transmit the RF data up-hole.

Figure 14:
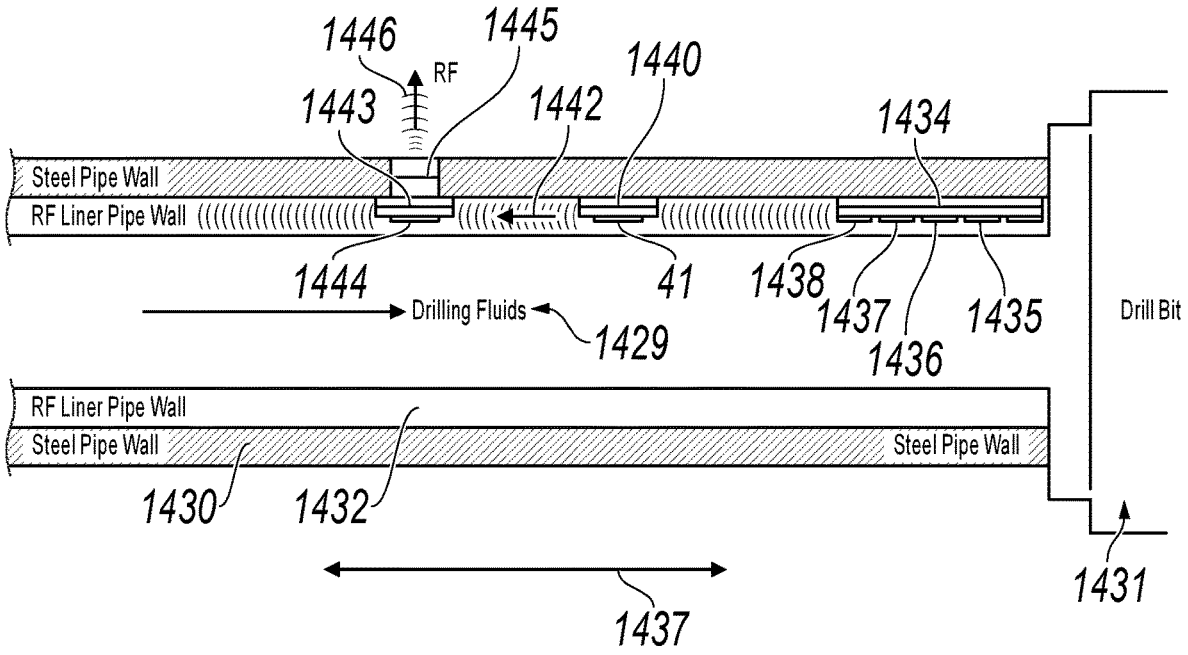
FIG. 14 is a cross sectional view of a pipe illustrating transmission of an RF signal from an annular sensor package.

FIG. 14 illustrates the transmission of RF signal 1442 from an annular sensor package 1434, fitted into the outside wall 1432 of the internal pipe that is capable of transmitting RF signals, near the drill bit 1431. The annular sensor package is comprised of a transmitting antenna 1438, spatial proximity sensors 1437, geophysical sensors 1436, and drilling parameter sensors 1435. The transmitting antenna 1438 transmits the RF signal 1442 to a repeater 1440 which contains a receiving and transmitting antennae 1441 and further transmits the RF signal 1442 to a receiving antennae 1444 which is connected to a recessed reflector antenna 1443 mounted in a port 1445 in the drill pipe to transmit RF data 1446 outside of the pipe.

To manage battery life in a drilling application data from the annular sensor package 1424 can be acquired through an activating motion 1447 along the axis of the drill pipe. Accelerometers in the MCU (906 FIG. 9B) manage the signal transmission through a programmable sleep/awake logic. The activation 1437 can be any programed series of axial or rotary motions performed at a set frequency. Activation will cause the MCU to awaken the annular sensor package 1434 and transmit the data through RF signals along the wall of the capable pipe 1442, and outside of the drill pipe 1446 to the drill operator.

Figure 15:
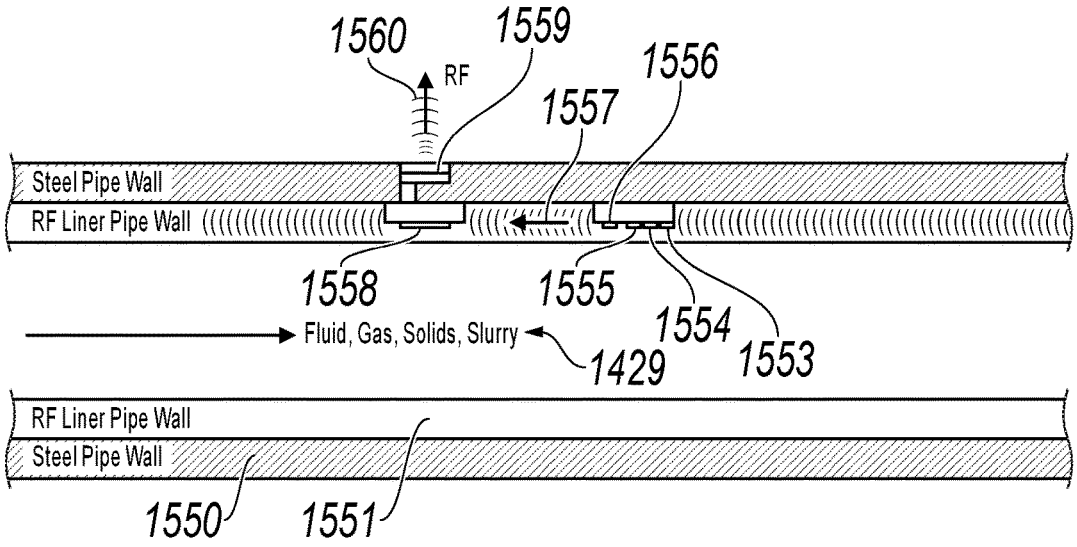
FIG. 15 is a cross-sectional view of a pipe illustrating transmission of an RF signal along an inner pipe wall according to an exemplary embodiment.

FIG. 15 illustrates the transmission of RF signal 1557 along an inner pipe wall 1551 that is capable of transmitting RF signal and that is mounted to the internal diameter of a steel transmission pipe 1550, for example, which transports gases, fluids, slurry, or solids through the internal diameter of the inner pipe 1551. Along the pipe 1550 and imbedded into the outer diameter of the internal pipe capable of transmitting RF signal 1551 is a PCB mounted annular sensor package comprised of a multitude of sensors to derive the characteristics of the gas, fluid, slurry, or solid flowing in the pipe, such as static pressure 1555, velocity 1554, and temperature 1553, or any other parameter that can be measured to provide pipe flow characteristics, as shown on FIG. 15. An antenna 1556 transmits data from the sensor package through the wall of the pipe capable of transmitting RF signal to a repeater, or to a receiving antenna 1558 connected to a recessed reflector antennae mounted in a port on the outside of the steel pipe to enable transmission of RF signal outside of the pipeline. In the case of pipelines where motion to activate and manage sensor sleep/awake cycles to manage battery life, acoustic sensors may be imbedded into the PCB's and programed to activate the data acquisition system based on noise, impacts to the pipe performed at programed frequencies.

Figure 16:
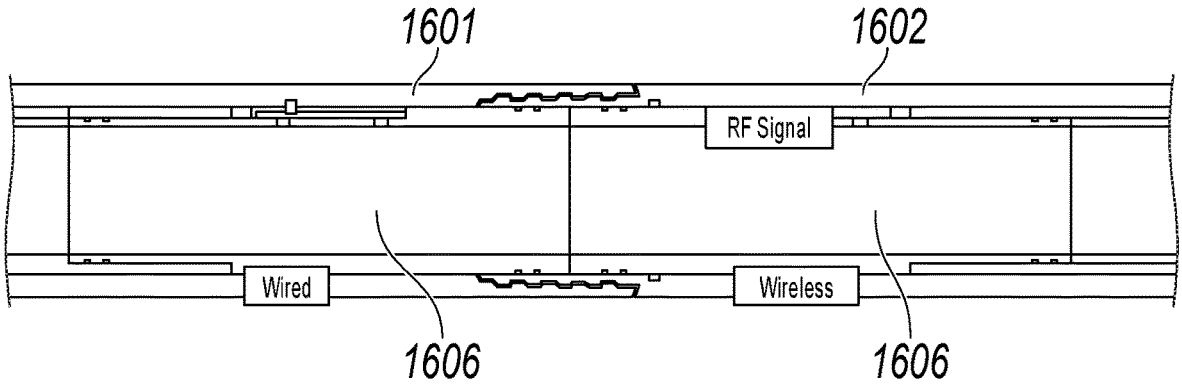
FIG. 16 is a side view of a pipe containing a circuit board according to an exemplary embodiment.
Figure 17:
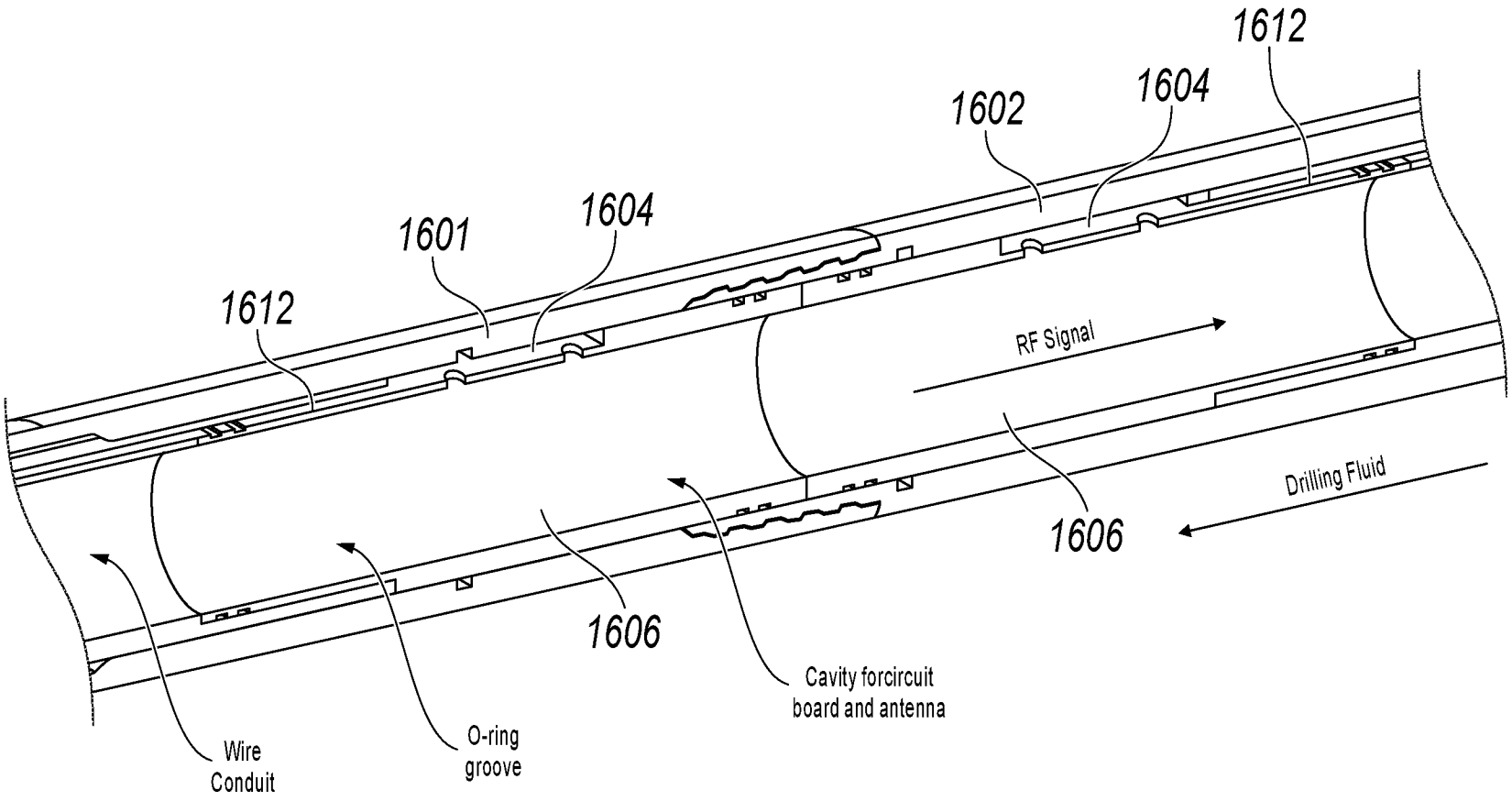
FIG. 17 is a perspective view of a pipe containing a circuit board according to an exemplary embodiment.
Figure 18:
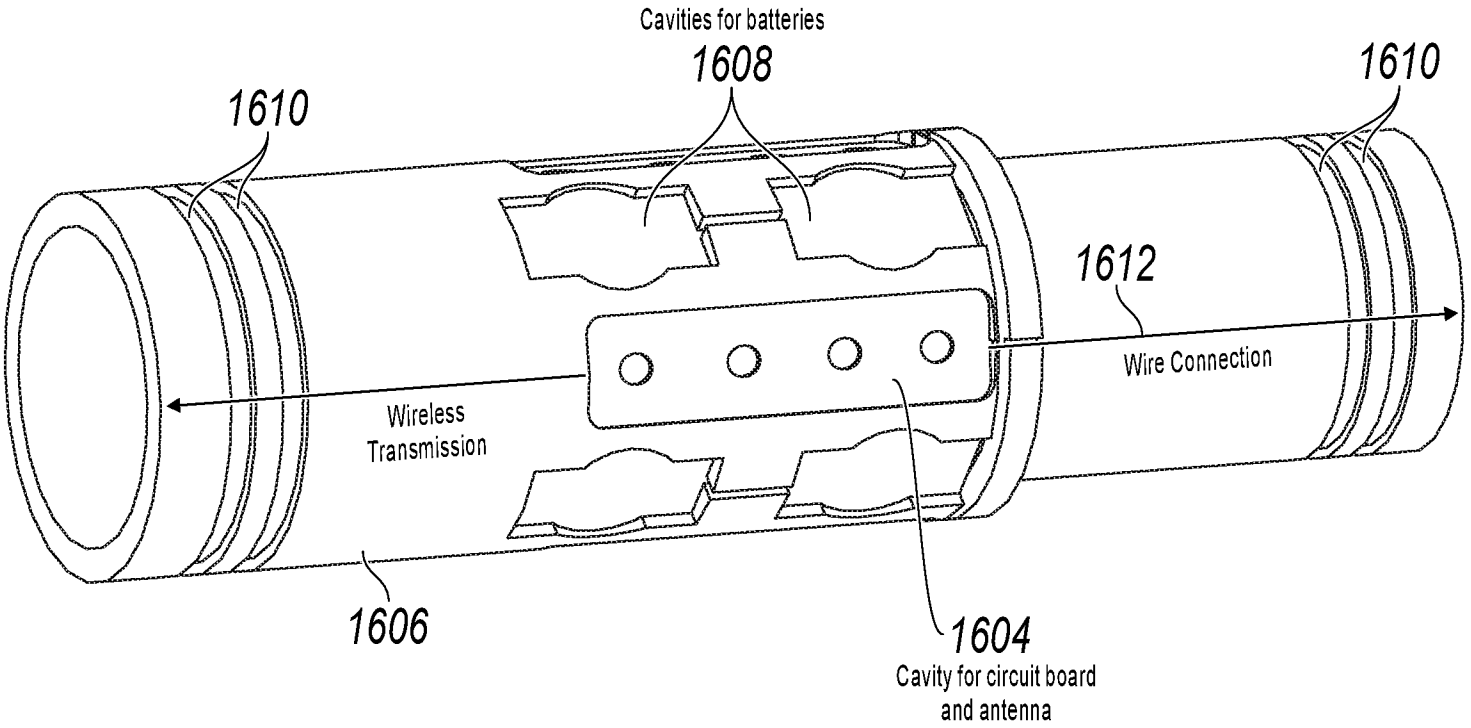
FIG. 18 is a perspective view of the circuit board of FIG. 17 with the pipe removed for illustration according to an exemplary embodiment.

FIG. 16 is a side view of a pipe containing within it a communication system. FIG. 17 is a perspective view of a pipe containing within it a communication system. FIG. 18 is a perspective view of a circuit boardhousing with the pipe removed for illustration. Referring to FIGS. 16-18 collectively, a drill rod 1602 is inserted with a plastic sleeve 1604 having a slot 1612 cut into its outer surface to serve as a conduit for a wire along the majority of the length of the drill rod 1602. Near the ends of the drill rod 1602, however, the wire conduit 1612 is connected to a dielectric housing 1606 containing a circuit board cavity 1604 in which sits a PCB containing an antenna for sending or receiving signals. The circuit board and antenna are positioned in the dielectric housing 1606 shown in the assembly in FIGS. 17-18. When the male end of the drill rod 1602 is mated with the female end of an adjacent drill rod 1601, the two dielectric housings 1606 contact each other, creating a path through which the RF signal can travel. The RF signal will not travel through the drilling fluid that occupies the central opening of the drill rod 1602 or the adjacent drill rod 1601 so the RF signal must pass through the dielectric housings 1606. The dielectric housing 1606 contains at least one cavity 1608 for a battery that is in communication with the PCB. The dielectric housings 1606 are removable so that the batteries can be accessed for charging or for replacement. A plurality of groves 1610 are formed at opposite ends of the dielectric housing 1606. In operation, the plurality of grooves 1610 receive, for example, O-rings that provide sealing between the dielectric housing 1606 and the drill rod 1602.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A drill-pipe communication assembly comprising:

a first drill pipe, wherein the first drill pipe is non-conductive;

a second drill pipe disposed within the first drill pipe, wherein the second drill pipe is conductive;

an antenna electrically coupled to the first drill pipe, the antenna facilitating wireless transmission of signals along a length of the second drill pipe; and a repeater disposed within the second drill pipe, the repeater comprising a repeater antenna that transmits radio frequency signals along a length of the second drill pipe, wherein the repeater antenna is recessed in the second drill pipe.

2. The drill-pipe communication assembly of claim 1, comprising a master control unit that controls transmission and reception functions of the antenna.

3. The drill-pipe communication assembly of claim 1, comprising at least one of an accelerometer and a gyroscope to monitor movements of at least one of the first drill pipe and the second drill pipe.

* * * * *